US009399835B2

(12) United States Patent
Kirov et al.

(10) Patent No.: US 9,399,835 B2
(45) **Date of Patent: *Jul. 26, 2016**

(54) METHOD OF MANUFACTURING PULP FOR CORRUGATED MEDIUM

(71) Applicant: Packaging Corporation of America, Lake Forest, IL (US)

(72) Inventors: Ventzislav H. Kirov, Lake Forest, IL (US); Namhee Shin, Lake Forest, IL (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/593,687

(22) Filed: Jan. 9, 2015

(65) Prior Publication Data

US 2015/0122431 A1 May 7, 2015

Related U.S. Application Data

(63) Continuation of application No. 13/703,269, filed as application No. PCT/US2011/039974 on Jun. 10, 2011, now Pat. No. 8,961,740.

(60) Provisional application No. 61/353,489, filed on Jun. 10, 2010.

(51) Int. Cl.

| | |
|---|---|
| ***D21C 9/147*** | (2006.01) |
| ***D21C 3/00*** | (2006.01) |
| ***D21C 3/02*** | (2006.01) |
| ***D21C 3/26*** | (2006.01) |
| ***D21D 1/20*** | (2006.01) |
| ***D21H 11/02*** | (2006.01) |
| *D21C 9/02* | (2006.01) |

(52) U.S. Cl.
CPC *D21C 9/147* (2013.01); *D21C 3/00* (2013.01); *D21C 3/02* (2013.01); *D21C 3/026* (2013.01); *D21C 3/263* (2013.01); *D21D 1/20* (2013.01); *D21H 11/02* (2013.01); *D21C 9/02* (2013.01)

(58) Field of Classification Search
CPC ..... D21C 9/147; D21C 9/1068; D21C 3/263
USPC ..... 162/24, 25
See application file for complete search history.

(56) References Cited

U.S. PATENT DOCUMENTS

| | | | | |
|---|---|---|---|---|
| 3,773,611 | A | 11/1973 | Worster et al. | 162/25 |
| 3,888,727 | A | 6/1975 | Kenig | |

(Continued)

FOREIGN PATENT DOCUMENTS

| | | |
|---|---|---|
| EP | 0 540 091 A1 | 5/1993 |
| GB | 1 392 770 | 4/1975 |

(Continued)

OTHER PUBLICATIONS

European Search Report mailed Nov. 24, 2011.

(Continued)

*Primary Examiner* — Anthony Calandra
(74) *Attorney, Agent, or Firm* — Nixon & Vanderhye P.C.

(57) ABSTRACT

A method to make pulp adapted for forming a corrugated medium, the method includes: cooking chips in a cooking vessel using a caustic carbonated pulping soda/caustic (SC) cooking liquor injected into the cooking vessel; fiberizing the chips discharged from the cooking vessel to form a pulp, and removing lignin from the pulp or oxidizing lignin in the pulp by injecting oxygen ($O_2$) into the fiberized pulp.

37 Claims, 2 Drawing Sheets

(56) References Cited

U.S. PATENT DOCUMENTS

| | | | | |
|---|---|---|---|---|
| 4,076,579 | A | 2/1978 | Brink | 162/53 |
| 4,869,783 | A | 9/1989 | Prusas et al. | |
| 2005/0155730 | A1 | 7/2005 | Stigsson | |

FOREIGN PATENT DOCUMENTS

| | | | |
|---|---|---|---|
| WO | WO 96/33308 | A1 | 10/1996 |
| WO | WO 00/47812 | A1 | 8/2000 |
| WO | WO 00/73575 | A1 | 12/2000 |
| WO | WO 2004/025020 | | 3/2004 |

OTHER PUBLICATIONS

Worster H.E., Semichemical Pulping for Corrugating Grades VI (A chapter in Sulfite Science and Technology edited by Ingruber et al.), 1985, The Joint Textbook Committee of the Paper Industry, p. 130-150 and 156-157.

Smook, Handbook for Pulp and Paper Technologies, 1992, Angus Wilde Publications, 2nd edition, chapters 4 and 9.

Table 1 PULP PHYSICAL PROPERTIES AT 400 CSF-PFI MILL

| SAMPLE PULPING PROCESS | O2 Consistency % | Shives 10 cut/% | Porosity Gurley | Burst lb/sq.in | Tensile lb/in | Tear gf | Ring Crush lb | CMT lb | Yield % |
|---|---|---|---|---|---|---|---|---|---|
| 1. WASHED PULPS | | | | | | | | | |
| CW-1 REG.SODA SC PULP | | 55 | 7.7 | 25.7 | 24.1 | 48.5 | 51.5 | 42.9 | 85 |
| CWO-1 REG. SC PULP + O2 | 10 | 55 | 10.9 | 35 | 32.2 | 61.9 | 59.1 | 52.6 | 74.9 |
| DD -1 REG.SODA SC PULP | | 10 | 8.3 | 22.1 | 22.3 | 42.8 | 48.2 | 37.9 | 85 |
| DDO-1 REG SC PULP + O2 | 10 | 10 | 20.6 | 41.5 | 34.1 | 74.1 | 63.5 | 58.5 | 75.6 |
| 2. UNWASHED PULPS | | | | | | | | | |
| Tu REG,SODA SC PULP | | 35 | 6.7 | 19.2 | 20.3 | 38.2 | 44.1 | 35.8 | 85 |
| B-1 REG Tu PULP + O2 | 25 | 35 | 20 | 33.2 | 28.6 | 54.9 | 57.1 | 52.6 | 76.2 |
| B-1 REG. Tu PULP - O2 | 10 | 35 | 11.7 | 26.5 | 24.6 | 52.6 | 49.5 | 42.6 | 80.7 |

Figure 2

METHOD OF MANUFACTURING PULP FOR CORRUGATED MEDIUM

CROSS-REFERENCES TO RELATED APPLICATIONS

This application is a continuation of U.S. patent application Ser. No. 13/703,269, filed Dec. 10, 2012, and claims priority to PCT Application PCT/US2011/039974, filed Jun. 10, 2011, and U.S. Provisional Patent Application Ser. No. 61/353,489, filed Jun. 10, 2010, each of which applications are incorporated in their entirety by reference herein.

BACKGROUND OF THE INVENTION

The present invention relates generally to a method of manufacturing pulp and more particularly to a method of manufacturing pulp to be used for making corrugated medium.

A wide range of methods exist for manufacturing semi-chemical pulp to be used for making a corrugated medium. For example, the high yield hardwood pulps used in manufacturing corrugating medium may be produced using semi-chemical pulping processes including soda/caustic pulping, neutral sulfite semi-chemical (NSSC) pulping, and green liquor pulping. Depending on the manufacturing method used, the pulp yield generally varies from 75 percent (%) to 82% for NSSC pulping and up to 85% to 86% for green liquor and soda/caustic pulping. Typically low yields pulps result from treatment with sulfur containing cooking chemicals, which provide better pulp quality than high yield pulps.

Standard soda/caustic (SC) pulping is a popular method for puling. SC pulp manufacturing is attractive due to inexpensive cooking chemicals and a relatively easy and simple chemical recovery process. The pulp quality from standard soda/caustic pulping tends to be inferior to the pulp quality generated by NSSC pulping. The pulp quality is a major disadvantage for soda/caustic pulping, especially for paper grades requiring high results for the ring crush test and corrugated medium test (CMT).

BRIEF DESCRIPTION OF THE INVENTION

A new method and system for soda/caustic pulping has been developed that provides high quality pulp, e.g., higher ring crush and CMT values than typically obtained with the standard soda/caustic pulping. The new method and system may also have the same easy and simple chemical recovery of standard soda/caustic pulping and thereby minimize the environment pollution.

A method has been conceived to make pulp comprising: cooking chips, e.g., wood chips, in cooking vessel using a soda, caustic or green cooking liquor injected into the cooking vessel; fiberizing the chips discharged from cooking vessel to form a pulp, and removing lignin from the pulp or oxidizing lignin in the pulp by injecting oxygen ($O_2$) into the fiberized chips (pulp). The fiberized chips may be washed to form the pulp adapted to form, for example, a corrugated medium. The method may use cooking liquor that includes one or more of soda (NaOH) and soda ash ($Na_2CO_3$). The method may also include a mechanical fiberizing process. The pulp may be refined after removing or oxidizing the lignin and used to form corrugated medium. The step of removing or oxidizing the lignin may be performed at a temperature in a range of 120 degrees Fahrenheit (deg. F.) to 300 deg. F. and for a period in a range of 5 minutes to 120 minutes.

A method has been conceived to make pulp comprising: cooking chips in a cooking vessel using a caustic carbonated pulping cooking liquor injected into the cooking vessel; fiberizing the chips discharged from the cooking vessel to form a fiberized pulp; removing lignin from the pulp or oxidizing lignin in the pulp by injecting oxygen ($O_2$) into the fiberized pulp, and washing the fiberized pulp to form the pulp. The cooking liquor may include at least one of a soda, caustic or green cooking liquor. Further, the cooking liquor may include one or more of soda (NaOH), soda ash ($Na_2CO_3$) and sodium sulfide ($Na_2S$).

BRIEF DESCRIPTION OF THE DRAWINGS

FIG. 2 is a table of Pulp Physical Properties resulting from various pulping processes.

DETAILED DESCRIPTION OF THE INVENTION

Figure 1:
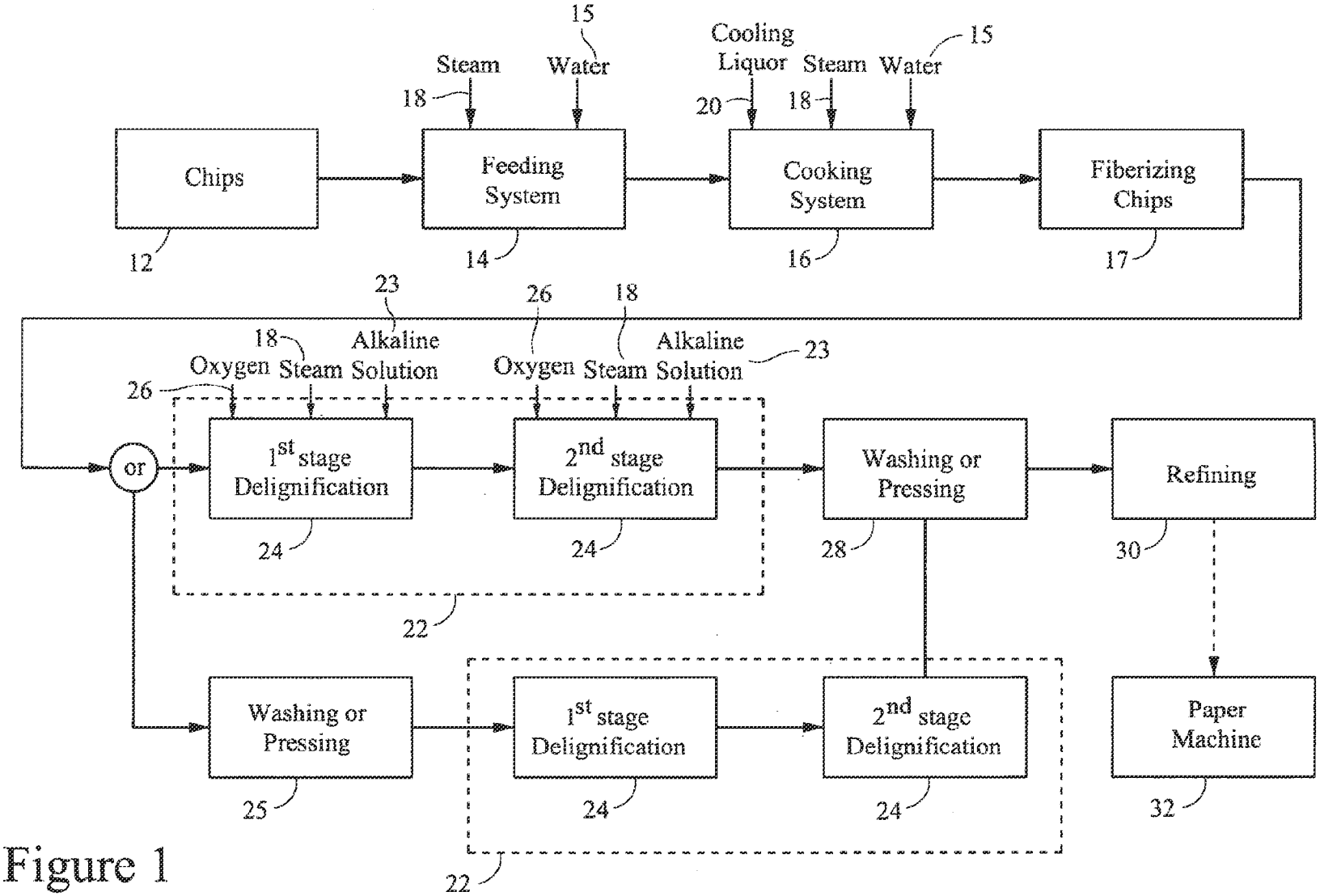
FIG. 1 is a flow diagram of a method to manufacture pulp.

FIG. 1 is a flow diagram of a method 10 to manufacture pulp. The new method comprises soda or soda ash (or both) cooking followed by multistage delignification, for manufacturing corrugated medium from wood chips.

Wood chips 12 (or other comminuted cellulosic fibrous material—collectively referred to as "chips") may be a mixed-blend of wood from various species of hardwood, deciduous trees including, but not limited to, ash, aspen, beech, basswood, birch, black cherry, black walnut, butternut, buckeye, chestnut, cottonwood, dogwood, elm, eucalyptus, gmelina, hackberry, hickory, holly, locust, magnolia, maple, oak, poplar, red alder, redbud, royal paulownia, sassafras, sweetgum, sycamore, tupelo, willow, yellow-poplar, and combinations thereof. The wood chips may also comprise wood from various varieties within the species of trees. It is contemplated that other species of hardwood, deciduous trees may be used. It is also contemplated that a single species of hardwood, deciduous trees may be used. Bagasse, straw, kenaf, hemp, and combinations thereof may also be used to form the chips. It is contemplated that the chips may include wood from hardwood, deciduous trees in combination with non-wood fibers including those discussed above. The chips may be supplied from a wood yard or a wood room in a pulping mill.

The chips are fed using a conventional chip feed system 14 to a cooking vessel 16, such as a batch digester, a continuous digester, and a Pandia type digester. The chip feed system 14 may add steam 18 and liquor 15, e.g., water, to the chips being transported through the chip feed system to the cooking vessel.

The chips are treated in cooking vessel 16 with, for example, regular soda ash ($Na_2CO_3$) which is added in amount approximately 10% of the bone dry weight (bdw) of the chips added to the vessel 16. The regular soda ash is added from a liquor supply 20 that injects the soda ash, with the cooking liquor, into the vessel of the cooking system 16 or into the chip feed system 14 upstream of the vessel.

The chips and cooking liquor are heated in the vessel 16, such as with steam 18 injected to the vessel to a temperature in a range of 330 degrees (deg.) Fahrenheit (F) to 380 deg. F., or in a range 360 deg. F. to 370 F. The chips are retained in the vessel for a period such as two (2) to fifteen (15) minutes, or 4 to 10 minutes. The chips are mechanically fiberized in a chip fiberizing vessel 17, such as defiberator or refiner vessel, to a shines content of, for example, 10% to 50%, or 30% to 45%.

The fiberized chips are discharged from the fiberizing vessel 17 and directed to one or more stages 22 of delignification, such as a continuous or batch chemical reactor(s) 24. The delignification stages may remove or oxidize the lignin in the fiberized chips using oxidizing agents 26 such as one or more of oxygen, hydrogen peroxide and ozone.

The fiberized chips from the vessel 17 may be optionally washed 25 using a wash liquid, e.g., water, before entering the delignification stage(s) 22 and washed between each of the individual delignification stages 24. FIG. 1 shows by the branch "or" in the flow path that the washing or pressing stages 25 are optional, and may precede the delignification stage(s) 22 and be between the individual delignification stages 24. In particular, FIG. 1 shows alternative flow paths branching at the "or". The delignification stages 22 may be the same in both braches of the flow path. In particular, each of the delignification stages 22 may add one or more of oxygen ($O_2$) 26, steam 18 and alkaline solutions 23 to one or more of the individual delignification stages 24.

Each of the delignification stages(s) 24 may treat the fiberized chips with oxygen ($O_2$) and maintain the chips at a temperature of, for example, 120 deg. F. to 300 deg. F. or 200 deg. F. to 230 deg. F. These stage(s) 24 may maintain the chips under pressures of 60 pounds per square inch (psig) to 110 psig for a period of 5 to 120 minutes or 20 minutes to 40 minutes at 5% to 45% (or even 10% to 30%) consistency of pulp to liquor.

The fiberized chips 17 may have a shines content of 35% to 45% after treatment with oxygen ($O_2$) 26 in the delignification stage(s) 22. The pH level in each of the delignification stages 24 may be alkaline pH. The target pH of the chips being discharged from the delignification stages may be in a range of 7 pH to 12 pH or 8 pH to 10 pH. Downstream of the delignification stages 22, the oxygen delignified pulp, which may have a shines content of 35% to 45%, is washed 28 and refined 30 before entering a paper machine 32 that forms the pulp into corrugated paper or other corrugated medium.

Preliminary results have been obtained using the pulping process described above. These results are shown in the table of FIG. 2. The results indicate a significant improvement in pulp quality using the novel SC pulping process described above. Major physical pulp properties such as Ring Crush, CMT, Mullen, Tensile, and Tear strength were improved by 25% to 40% as compared to standard one stage carbonate pulp for final pulp yields of 75% to 80%. There is a strong correlation between pulp quality improvement and the final yield as well as pulp consistency and degree of pulp washing prior oxygen treatment.

The oxygen delignification process is described above in the context of a soda, caustic or green (soda/caustic/green) liquor cooking process. This oxygen delignification process is not limited to soda/caustic/green cooking. The oxygen delignification described above may also be applied to all other cooking processes to produce pulp, such as for a corrugated medium.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A method to make washed pulp comprising:

semi-chemically pulping comminuted cellulosic fibrous material in a cooking vessel using a cooking liquor injected into the cooking vessel;

fiberizing the cooked fibrous material discharged from the cooking vessel to form a fiberized pulp for a corrugated medium;

removing lignin from the fiberized pulp or oxidizing lignin in the fiberized pulp by injecting oxygen ($O_2$) into the fiberized pulp in an oxygen delignification treatment;

washing the fiberized pulp to form the washed pulp; and producing a corrugated medium using the washed pulp;

wherein immediately before the fiberized pulp is injected with oxygen ($O_2$) for oxygen delignification treatment, the fiberized pulp has a shives content of between at least 20% to 50%.

2. The method of claim 1 wherein the cooking liquor is at least one of a soda, caustic or green cooking liquor.

3. The method of claim 1 wherein the cooking liquor includes one or more of soda (NaOH), soda ash ($Na_2CO_3$) and sodium sulfide ($Na_2S$).

4. The method of claim 1 wherein the fiberizing of the cooked fibrous material includes mechanical fiberizing of the fiberized pulp.

5. The method of claim 1 wherein the washing occurs after the removal of the lignin.

6. The method of claim 1 further comprising refining the fiberized pulp after removing or oxidizing the lignin.

7. The method of claim 1 wherein the fibrous material includes wood chips.

8. The method of claim 1 wherein the removal or the oxidation of the lignin is performed at a temperature in a range of 120 degrees Fahrenheit (° F.) to 300° F. and for a period in a range of 5 minutes to 120 minutes.

9. The method of claim 1 wherein the removal or the oxidation of the lignin is performed at a temperature in a range of 200° F. to 230° F. and for a period in a range of 20 minutes to 40 minutes.

10. The method of claim 1 wherein the fiberized pulp have a shives content of 35% to 45% after the removal or the oxidization of the lignin.

11. The method of claim 1 wherein the removal or the oxidation of lignin includes injection of an alkaline solution.

12. A method to make pulp comprising:

cooking comminuted cellulosic fibrous material in a cooking vessel using a cooking liquor injected into the cooking vessel, wherein the cooking liquor includes at least one of a soda, caustic, carbonated, neutral sulfite and green cooking liquor;

fiberizing the fibrous material discharged from the cooking vessel to form a fiberized pulp for a corrugated medium, and injecting oxygen ($O_2$) into the fiberized pulp in an oxygen delignification treatment and washing the fiberized pulp;

wherein immediately before the fiberized pulp is injected with oxygen ($O_2$) for oxygen delignification treatment, the fiberized pulp has a shives content of between at least 20% to 50%.

13. The method of claim 12 wherein the cooking liquor includes one or more of soda (NaOH), soda ash ($Na_2CO_3$) and sodium sulfide ($Na_2S$).

14. The method of claim 12 wherein the fiberizing of the fibrous material includes mechanical fiberizing.

15. The method of claim 12 wherein the washing occurs after the removal of the lignin.

16. The method of claim 12 further comprising refining the fiberized pulp after removing or oxidizing the lignin.

17. The method of claim 12 wherein the comminuted cellulosic fibrous material includes wood chips.

18. The method of claim 12 wherein the removal or the oxidation of the lignin is performed at a temperature in a range of 120 degrees Fahrenheit to 300 degrees Fahrenheit and for a period in a range of 5 minutes to 120 minutes.

19. The method of claim 12 wherein the removal or the oxidation of the lignin is performed at a temperature in a range of 200 degrees Fahrenheit to 230 degrees Fahrenheit and for a period in a range of 20 minutes to 40 minutes.

20. The method of claim 12 further comprising using the washed fiberized pulp to form a corrugated paper.

21. The method of claim 12 wherein the fiberized pulp have a shives content of 35% to 45% after the removal or the oxidization of the lignin.

22. The method of claim 12 wherein the removal or the oxidation of lignin includes injection of an alkaline solution.

23. A method to pulp comprising:

semi-chemically pulping cellulosic fibrous material in a cooking vessel using a cooking liquor injected into the cooking vessel;

fiberizing the fibrous material discharged from the cooking vessel to form a fiberized pulp for a corrugated medium;

removing lignin from the pulp or oxidizing lignin in the fiberized pulp by injecting oxygen ($O_2$) into the fiberized pulp in an oxygen delignification treatment, and washing the fiberized pulp;

wherein immediately before the fiberized pulp is injected with oxygen ($O_2$) for oxygen delignification treatment, the fiberized pulp has a shives content of between at least 20% to 50%.

24. The method of claim 23 wherein the cooking liquor includes at least one of a soda, caustic, caustic carbonated, green and a neutral sulfite semi-chemical cooking liquor.

25. The method of claim 23 wherein the cooking liquor includes one or more of soda (NaOH), soda ash ($Na_2CO_3$) and sodium sulfide ($Na_2S$).

26. The method of claim 23 wherein the fiberizing of the fibrous material includes mechanical fiberizing of the material.

27. The method of claim 23 wherein the washing occurs after the removal of the lignin.

28. The method of claim 23 further comprising refining the pulp after removing or oxidizing the lignin.

29. The method of claim 23 wherein the fibrous material includes wood chips.

30. The method of claim 23 wherein the removal or the oxidation of the lignin is performed at a temperature in a range of 120° F. to 300° F. and for a period in a range of 5 minutes to 120 minutes.

31. The method of claim 23 wherein the removal or the oxidation of the lignin is performed at a temperature in a range of 200° F. to 230° F. and for a period in a range of 20 minutes to 40 minutes.

32. The method of claim 23 further comprising using the pulp to form a corrugated paper.

33. The method of claim 23 wherein the fiberized pulp has a shives content of 35% to 45% after the removal or the oxidization of the lignin.

34. The method of claim 23 wherein the removal or the oxidation of lignin includes injection of an alkaline solution.

35. The method of claim 1 further comprising passing the washed pulp through a paper machine to form corrugated medium.

36. The method of claim 12 further comprising passing the washed pulp through a paper machine to form corrugated medium.

37. The method of claim 23 further comprising passing the washed pulp through a paper machine to form corrugated medium.

* * * * *